US005172577A

United States Patent [19]

Gibson

[11] Patent Number: 5,172,577

[45] Date of Patent: Dec. 22, 1992

[54] TIMED DOOR LOCKING DEVICE

[76] Inventor: Alfred G. Gibson, 9186 214 St, Langley V1M 2C1, British Columbia, Canada

[21] Appl. No.: 634,616

[22] Filed: Dec. 27, 1990

[51] Int. Cl.[5] ..... E05B 43/00

[52] U.S. Cl. ..... 70/272; 70/DIG. 41; 292/DIG. 69; 292/269; 194/241

[58] Field of Search ..... 70/267, 268, 272, DIG. 41, 70/277, 278, 413, DIG. 50; 292/DIG. 69, 269, 150; 194/227, 241

[56] References Cited

U.S. PATENT DOCUMENTS

| | | | |
|---|---|---|---|
| 1,510,562 | 10/1924 | Segal | 292/150 |
| 1,541,093 | 6/1925 | Amico | 292/150 |
| 2,551,730 | 5/1951 | Del Sol | 194/241 |
| 2,960,046 | 11/1960 | Clark . | |
| 2,991,866 | 7/1961 | James et al. . | |
| 3,065,619 | 11/1962 | Coss . | |
| 3,185,278 | 5/1965 | Miller et al. | 194/241 |
| 3,197,984 | 8/1965 | Cohen . | |
| 3,985,023 | 10/1976 | Guth . | |
| 4,401,346 | 8/1983 | Jones et al. | 292/251.5 |
| 4,880,406 | 11/1989 | Van Horn et al. | 194/227 |
| 4,958,867 | 9/1990 | Champagne | 292/DIG. 69 |

*Primary Examiner*—Renee S. Luebke
*Assistant Examiner*—D. Boucher
*Attorney, Agent, or Firm*—Barrigar & Oyen

[57] ABSTRACT

A door lock having a first member rigidly affixed adjacent a door and having a second member slidably coupled to the first member for slidably advancing the second member in a first direction into a locked position overlying the door. A latch member is carried by the second member for slidable advance of the latch member in a second direction so as to releasably mate the latch member within a latch aperture on the first member, thereby locking the second member in the locked position. A timer is carried by the seond member for withdrawing the latch member from the latch aperature upon expiry of a pre-determined time interval thereby allowing the slidable withdrawal of the second member from the locked position into an open position away from the door.

30 Claims, 2 Drawing Sheets

TIMED DOOR LOCKING DEVICE

FIELD OF THE INVENTION

This application pertains to a mechanism for locking conventional public laundromat washers and dryers so that the washer or dryer door may be locked closed for a fixed interval of time.

BACKGROUND OF THE INVENTION

Conventional automatic washers and dryers available in public laundromats are not adapted to be locked by patrons of the laundromat. Consequently, patrons cannot leave their laundry unattended in the washer or dryer without fear of having their laundry tampered with.

Washers or dryers found in publicly available laundromats conventionally have outwardly opening doors. In the prior art, timed door locks for locking outwardly opening doors typically use timers regulating electrically driven deadbolts, or timers regulating the manual operation of a mechanical latch or bolt mechanism. Mechanical timed door locks also typically utilize rotating cams which operate to sequence the mechanical linkages.

In particular, the applicant is aware of the following possibly pertinent patents disclosing various timed door lock devices:

| U.S. Pat. No. | Inventor | Issue Date |
|---|---|---|
| 2,960,046 | Clark | November 15, 1960 |
| 3,197,984 | Cohen | August 3, 1965 |
| 3,065,619 | Coss | November 27, 1962 |
| 3,985,023 | Guth | October 12, 1976 |
| 2,991,866 | James et al. | July 11, 1961 |

The Clark patent teaches the use of a time controlled latch mechanism which consists of external linkage which may be added to incinerators and like containers with hinged, outwardly opening doors not previously adapted to receive a locking device. Specifically, Clark discloses a deadbolt arrangement whereby the deadbolt is actuated by a manually operated lever and handle. The deadbolt cooperates with a hole in the outwardly opening door thereby preventing the opening of the door in the manner of a conventional deadbolt. Actuation of the deadbolt is blocked unless the outwardly opening door is properly closed. A timer is provided with a rotating slotted cam. Setting the timer turns the slotted cam which prevents the return of the deadbolt and, consequently prevents unlocking of the outwardly opening door by preventing the movement of the actuating lever until the slot in the cam is realigned with said lever.

Cohen teaches a timer mechanism which may be added externally to a door by the replacement of the keeper or striker of an ordinary latch bolt type of door lock (sometimes referred to as a "Yale" night latch). The latch bolt which ordinarily cooperates with a keeper or striker attached externally to the door frame is replaced by a keeper or striker which only cooperates with the latch bolt according to a preset timer sequence. The keeper or striker consists of an electrically operated solenoid driven plunger. In the embodiment disclosed, the plunger, when placed by the solenoid so as to cooperate with the latch bolt, prevents a door from being opened.

James et al., Coss and Guth all teach locking mechanisms which are necessarily integral to the design of the door being locked. James et al. discloses a spring loaded bolt which cooperates with a notch in a rotating cam, whereby the cam rotates as coins are fed into the mechanism until the notch is aligned with the bolt, and the bolt is returned into the notch allowing the door to be opened. Coss describes an electrically operated solenoid driven plunger which drives a wedge shaped cam, the cam cooperating with a locking bolt, whereby the solenoid actuates the plunger, the wedge cam pulls the bolt back against a return spring, unlocking the door. Guth discloses a rotating cam timer which rotates against a spring loaded lever. A notch in the cam aligns with the lever. Spring action causes the lever to engage a striker linkage which cooperates with the latch mechanism to open the door.

SUMMARY OF THE INVENTION

The present invention provides a device adapted to be mounted adjacent a washer or dryer outwardly opening door and provides for the timed locking of such a door. A timer-lock housing slides on a bracket so as to overlay the door. Mounted in the timer-lock housing is a timer which, when actuated, allows a latch to fall to engage a slot in the bracket thereby locking the housing in the position overlying the door. Upon expiry of a pre-determined time interval, the timer disengages the latch from the slot in the bracket allowing the housing to be manually slid back on the bracket, away from the door. The washer or dryer door may then be opened.

A door lock, comprising: (a) a first member for rigid affixation adjacent a door, said first member having a latch aperture therein; (b) a second member, slidably coupled to said first member, for slidable advance of said second member, in a first direction, into a locked position overlying said door; a latch member carried by said second member for slidable advance of said latch member, in a second direction, to releasably mate engage said latch member within said latch aperture, thereby locking said second member in said locked position; and, (d) timer means carried by said second member for withdrawing said latch member from said latch aperture, upon expiry of a predetermined time interval, thereby allowing slidable withdrawal of said second member in a direction opposite said first direction from said locked position into an open position away from said door, wherein said timer means further comprises means for timing said pre-determined time interval, coin slots adapted to receive coins, a handle for actuating said time, and a visual time indicator for indicating the time remaining before expiry of such predetermined time interval.

In the preferred embodiment, a rotating cam extending from the timer cooperates with the latch. When the timer is actuated, a striker on the cam is rotated away from the latch allowing the latch to fall and engage a slotted latch-guide on the bracket. The latch acts as a cam follower, resting on a cam surface on the striker until the striker is rotated away from the latch. The latch is aligned with the slot in the latch-guide when the timer-lock housing is slid on the bracket so as to overlay the door, blocking the door opening. When the timer is actuated, the latch is free to fall into the slot in the latch-guide so as to prevent the timer-lock housing from being slid back out of the way of the door opening. If required, a spring can be utilized to assist in having the latch fall into the slot. Upon expiry of a pre-determined time interval, the rotating cam striker engages the latch, raising the latch so as to disengage the latch from the slot in the latch-guide. The timer-lock housing may then be manually slid back on the bracket to allow access to the door and allowing the door to be opened. The timer-lock housing is adapted to receive coins in order to actuate the timer and a visual indicator of the time remaining before the expiry of the pre-determined time interval is provided.

In a further embodiment of the invention, the device is mounted on a door adjacent a door frame. In this embodiment, the door is of the type which must be pushed to be opened. Thus, when the timer-lock housing is slid in the bracket to overlay the door frame, the door is prevented from being pushed open.

DRAWINGS

The attached drawings disclose a specific embodiment of the invention which should not be construed as limiting the spirit or scope of the invention in any way.

DETAILED DESCRIPTION OF A SPECIFIC EMBODIMENT OF THE INVENTION

Figure 1:
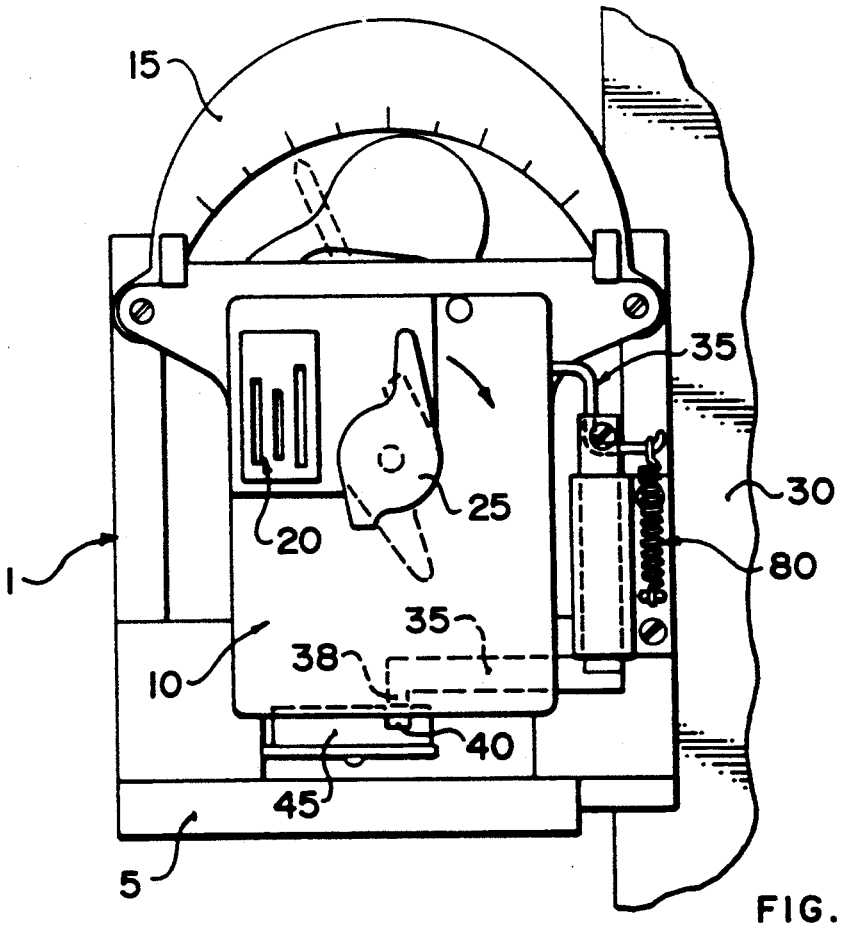
FIG. 1 is a front elevation view of the timer-lock housing mounted on the bracket, showing the timer adapted to receive coins and the timer visual time indicator.

Referring to the drawings, FIG. 1 is a front elevation view of the timer-lock housing mounted on the bracket, showing the timer adapted to receive coins and the timer visual time indicator. FIG. 1 specifically illustrates timer-lock housing 1 slidably mounted on bracket 5. The timer 10 and visual time indicator 15 are mounted on the front of housing 1. The timer 10 is adapted to receive assorted denominational coins in respective slots 20. The timer is actuated by insertion of coins in slots 20 and by rotation of knob 25. The timer-lock housing 1 is slid laterally on bracket 5 so as to overlay a door 30 of a typical appliance such as a washing machine or dryer.

Bracket 5 is mounted adjacent to door 30 so that when housing 1 is manually slid to the right (as seen in FIG. 1) on bracket 5 to overlay door 30, and the timer-lock is activated by insertion of coins and manual turning of knob 25, door 30 cannot be opened. When housing 1 is slid on bracket 5 to overlay door 30, a downwardly projecting protrusion 38 on latch 35 (shown in both solid and dotted lines) is aligned to engage in slot 40 formed in latch guide 45. When timer 10 is actuated, protrusion 38 on latch 35 is allowed to fall by gravity so as to engage in slot 40 in latch guide 45 thereby locking housing 1 in a position overlying door 30. One type of timer is of the "parking meter" type of timer manufactured by P.O.M. Incorporated of Russelville, Ark., U.S.A..

Figure 2:
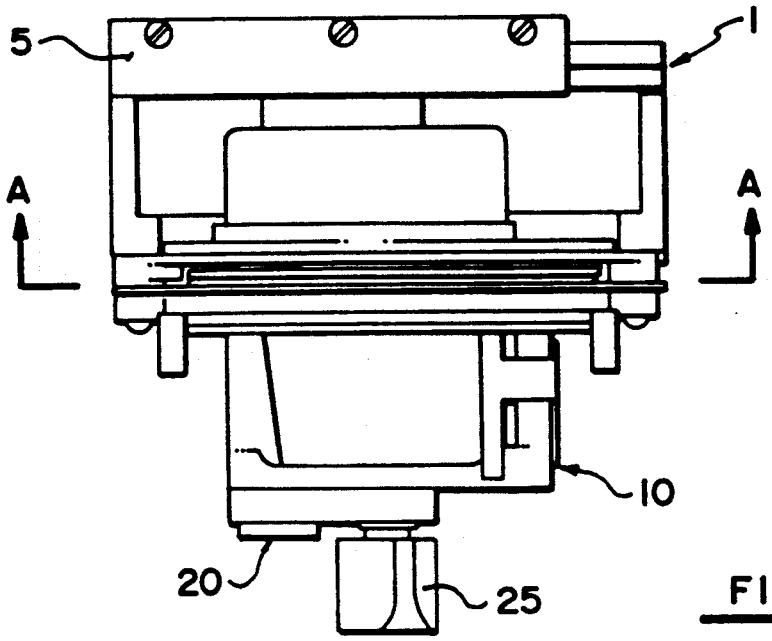
FIG. 2 is a top elevation view of the timer-lock housing mounted on the bracket showing the timer adapted to receive coins.

FIG. 2 illustrates a top view of the timer-lock housing 1 showing bracket 5 slidably mounted to the back of timer-lock housing 1. Timer 10 is mounted to the front of timer-lock housing 1. As seen in FIG. 2, the housing 1 is slid to the right so as to overlay a door (not shown in FIG. 2). FIG. 2 by cutaway view depicts the mechanism within coin actuated timer 10. The coin actuation mechanism is readily available in the marketplace as a coin operated parking meter. Turning knob 25 winds a spring (not shown) and thus sets the timer 10 to run for a pre-determined time interval.

Figure 3:
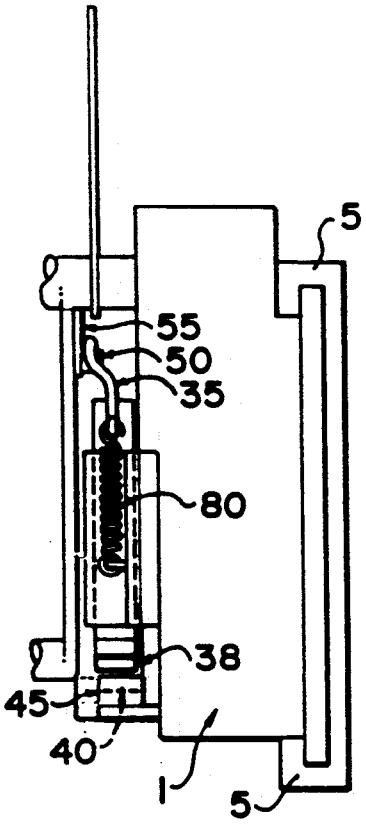
FIG. 3 is a side elevation view of the rear portion of the timer-lock housing mounted on the bracket, showing the timer visual time indicator.

FIG. 3 illustrates a side elevation view of the rear portion of the timer-lock housing 1 slidably mounted on bracket 5. When coin actuated timer 10 is actuated, rotating cam 55 is rotated clockwise (as seen from the front) thereby rotating striker 50 clockwise allowing latch 35 to fall under the force of gravity. When the housing 1 is moved to the right on bracket 5, and reaches its rightmost position, downward protrusion 38 on latch 35 drops into slot 40 formed in latch guide 45, thereby locking housing 1 in the rightmost position. When the timer 10 runs down, that is , when the timer mechanism returns to its neutral position, rotating cam 55 rotates counter-clockwise and striker 50 rotates counter-clockwise engaging latch 35 thereby raising latch 35 and protrusion 38 so as to disengage protrusion 38 from slot 40.

Figure 4:
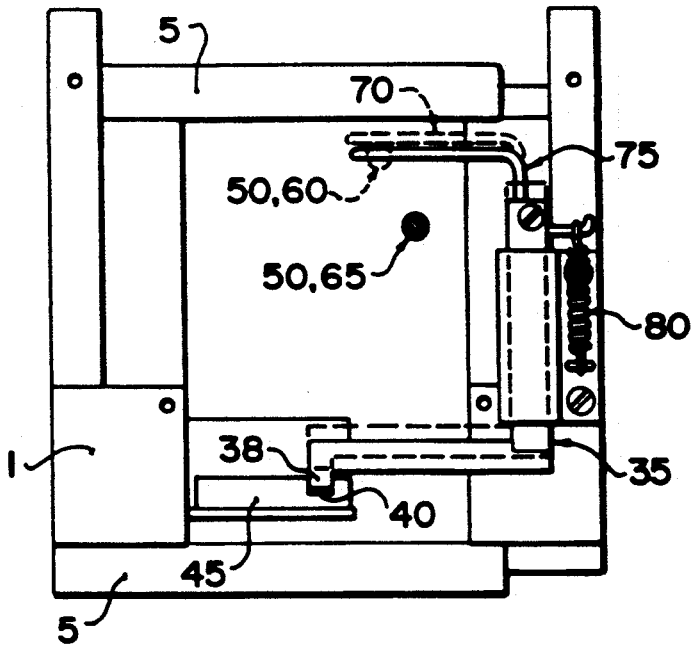
FIG. 4 is a section view taken along section line A—A of FIG. 2 showing the latch and the latch guide of the timer-lock.

FIG. 4 illustrates a section view taken along section line A—A of FIG. 2. Timer-lock housing 1 is mounted on bracket 5 at the rightmost position and striker 50 is rotated from a first latch-raised position 60 to a second latch-lowered position 65 so that latch 35 is allowed to fall from a first position 70 to a second position 75 whereby protrusion 38 on latch 35 engages slot 40 in latch guide 45.

Figure 5:
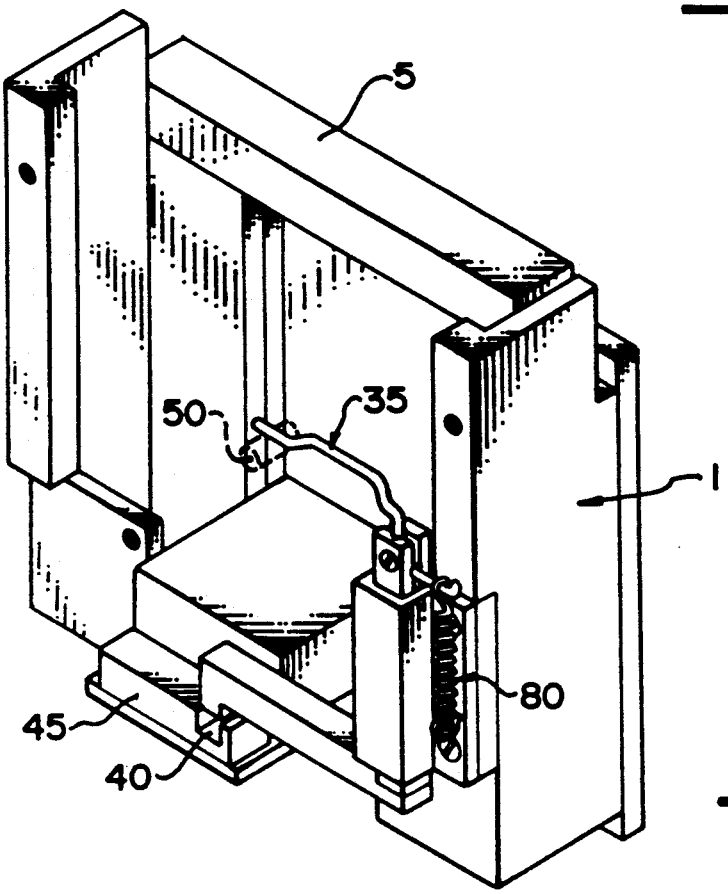
FIG. 5 is a front oblique isometric view showing the rear portion of the timer-lock housing in the locked position on the bracket. The timer is not shown.

FIG. 5 illustrates a front oblique isometric view of housing 1 in the rightmost position showing striker 50 in first latch-raised position 60, as described in association with FIG. 4, engaging latch 35 so that latch 35 is in first position 70. Latch 35 is in first position 70 and striker 50 is in first position 60 because no coins have been put into slots 20 and knob 25 has not been rotated so as to rotate cam 55 clockwise and rotate striker 50 into second position 65. Consequently, latch 35 has not been permitted to fall and protrusion 38 has not engaged slot 40.

FIGS, 1, 3, 4 and 5 also illustrate an alternative embodiment wherein latch 35 is urged against latch guide 45 by spring 80.

Operation of Timer-Lock

Basically the timed door lock device has a timer-lock housing, a timer 10, and a latch mechanism 35 lockably and slidably mounted on a bracket 5. The bracket 5 may be mounted immediately adjacent any outwardly opening door 30 and, in the preferred embodiment would be mounted adjacent a public laundromat washer or dryer door. The device has the advantage of either being adapted to any existing outwardly opening door 30 and frame, or being capable of being installed in any door and frame or appliance when the door or appliance is manufactured. The timer-lock housing 1 is slid on the bracket 5 to the rightmost position so as to overlay the door 30. The timer 10, when actuated by the insertion of a prescribed number of coins, and turning the knob 25 to the right, allows the latch 35 to fall to engage a slot 40 in the bracket 5, thereby locking the housing 1 in the position overlying the door 30 for a pre-determined period of time as governed by the number of coins inserted. If desirable, a spring 80 can be used to assist gravity in ensuring that the latch 35 falls into the slot 40.

Specifically, the timer-lock housing 1 is slid to the right on bracket 5 affixed adjacent an outwardly opening door 30 to block access to the door 30 and to prevent the door 30 from being opened. In the preferred embodiment, a rotating cam 55 extending from the timer 10 engages the latch 35. When the timer 10 is actuated, a striker 50 on the cam 55 is rotated away from the latch 35 allowing the latch 35 to fall and engage a slotted latch-guide 45 on the bracket 5. The latch 35 is aligned with the slot 40 in the latch-guide 45 when the timer-lock housing 1 is slid to the right on the bracket 5 so as to block the door 30 opening. When the timer 10 is actuated, the latch 35 is free to fall into the slot 40 in the latch-guide 45 so as to prevent the timer-lock housing 1 from being slid to the left, away from the door opening. Upon the expiry of the pre-determined time interval, the rotating cam striker 50 raises the latch 35 so as to disengage the latch 35 from the slot 40 in the latch-guide 45. The timer-lock housing 1 may then be manually slid to the left on the bracket 5 to allow access to the door 30. The door 30 may then be opened. In the preferred embodiment, the timer-lock housing 1 is adapted to receive coins in slots 20 and a knob 25 is provided which must be rotated in order to actuate the timer 10. A visual indicator of the time remaining before the expiry of the pre-determined time interval is also provided.

As will be apparent to those skilled in the art in the light of the foregoing disclosure, many alterations and modifications are possible in the practice of this invention. Without departing from the spirit or scope thereof. Accordingly, the scope of the invention is to be construed in accordance with the substance defined by the following claims.

What is claimed is;

1. A door lock, comprising:

(a) a first member for rigid affixation adjacent a door, said first member having a latch aperture therein;

(b) a second member, slidably coupled to said first member, for slidable advance to said second member, in a first direction, into a locked position overlying said door;

(c) a latch member carried by said second member for slidable advance of said latch member, in a second direction, to releasably mate said latch member within said latch aperture, thereby locking said second member in said locked position; and, (d) timer means carried by said second member for withdrawing said latch member from said latch aperture, upon expiry of a predetermined time interval, thereby allowing slidable withdrawl of said second member in a direction opposite said first direction from said locked position into an open position away from said door, wherein said timer means further comprises means for timing said pre-determined time interval, coin slots adapted to receive coins, a handle for actuating said timer, and a visual time indicator for indicating the time remaining before expiry of such pre-determined time interval.

2. A door lock, comprising:

(a) a first member for rigid affixation on a door, said first member having a latch aperture therein;

(b) a second member, slidably coupled to said first member, for slidable advance to said second member, in a first direction, into a locked position overlying said door;

(c) a latch member carried by said second member for slidable advance of said latch member, in a second direction, to releasably mate said latch member within said latch aperture, thereby locking said second member in said locked position; and, (d) timer means carried by said second member for withdrawing said latch member from said latch aperture, upon expiry of a predetermined time interval, thereby allowing slidable withdrawal of said second member from said locked position into an open position away from said door, frame, wherein said timer means further comprises means for timing said predetermined time interval, coin slots adapted to receive coins, a handle for actuating said timer, and a visual time indicator for indicating the time remaining before expiry of such predetermined time interval.

3. A door lock as claimed in claim 1 wherein said timer means comprises a rotating cam to withdraw said latch member from said latch aperture.

4. A door lock as claimed in claim 1 wherein said first member comprises a bracket slidably coupled to said second member.

5. A door lock as claimed in claim 4 wherein said first member further comprises a slotted latch-guide cooperating with said latch member.

6. A door lock as claimed in claim 5 wherein said second member comprises a housing slidably coupled to said bracket for carrying said timer means and said latch member within said housing.

7. A door lock as claimed in claim 3 wherein said first member comprises a bracket slidably coupled to said second member.

8. A door lock as claimed in claim 7 wherein said first member further comprises a slotted latch-guide cooperating with said latch member.

9. A door lock as claimed in claim 8 wherein said second member comprises a housing slidably coupled to said bracket for carrying said timer means and said latch member within said housing.

10. A door lock as claimed in claim 1 wherein said first direction is horizontal.

11. A door lock as claimed in claim 10 wherein said second direction is vertical.

12. A door lock as claimed in claim 3 wherein said rotating cam comprises a striker having a cam surface, and said latch member comprises a cam follower, whereby rotating said cam engages said cam surface with said cam follower raising said latch member.

13. A door lock as claimed in claim 6 wherein said latch member engages said latch aperture in said slotted latch-guide by fitting said latch member into said aperture when said timer means allows said latch member to fall under the force of gravity and said housing is slid on said bracket to overlay said door so that said latch member is aligned with said aperture.

14. A door lock as claimed in claim 9 wherein said latch member engages said latch aperture in said slotted latch-guide by fitting said latch member into said aperture when said timer means allows said latch member to fall under the force of gravity and said housing is slid on said bracket to overlay said door so that said latch member is aligned with said aperture.

15. A door lock as claimed in claim 2 wherein said timer means comprises a rotating cam to withdraw said latch member from said latch aperture.

16. A door lock as claimed in claim 2 wherein said first member comprises a bracket, slidably coupled to said second member.

17. A door lock as claimed in claim 16 wherein said first member further comprises a slotted latch-guide cooperating with said latch member.

18. A door lock as claimed in claim 17 wherein said second member comprises a housing slidably coupled to said bracket for carrying timer means and said latch member within said housing.

19. A door lock as claimed in claim 15 wherein said first member comprises a bracket slidably coupled to said second member.

20. A door lock as claimed in claim 19 wherein said first member further comprises a slotted latch-guide cooperating with said latch member.

21. A door lock as claimed in claim 20 wherein said second member comprises a housing slidably coupled to said bracket for carrying said timer means and said latch member within said housing 22. A door lock as claimed in claim 2 wherein said first direction is horizontal.

23. A door lock as claimed in claim 22 wherein said second direction is vertical.

24. A door lock as claimed in claim 15 wherein said rotating cam comprises a striker having a cam surface, and said latch member comprises a cam follower, whereby rotating said cam engages said cam surface with said cam follower raising said latch member.

25. A door lock as claimed in claim 18 wherein said latch member engages said latch aperture in said slotted latch-guide by fitting said latch member into said aperture when said timer means allows said latch member to fall under the force of gravity and said housing is slid on said bracket to overlay said door so that said latch member is aligned with said aperture.

26. A door lock as claimed in claim 21 wherein said latch member engages said latch aperture in said slotted latch-guide by fitting said latch member into said aperture when said timer means allows said latch member to fall under the force of gravity and said housing is slid on said bracket to overlay said door so that said latch member is aligned with said aperture.

27. A door lock as claimed in claim 6 wherein said latch member engages said latch aperture in said slotted latch-guide by fitting said latch member into said aperture when said timer means allows said latch member to fall under the force of a return spring and said housing is skid on said bracket to overlay said door so that said latch member is aligned with said aperture.

28. A door lock as claimed in claim 9 wherein said latch member engages said latch aperture in said slotted latch-guide by fitting said latch member into said aperture when said timer means allows said latch member to fall under the force of a return spring and said housing is said on said bracket to overlay said door so that said latch member is aligned with said aperture.

29. A door lock as claimed in claim 18 wherein said latch member engages said latch aperture in said slotted latch-guide by fitting said latch member into said aperture when said timer means allows said latch member to fall under the force of a return spring and said housing is slid on said bracket to overlay said door frame so that said latch member is aligned with said aperture.

30. A door lock as claimed in claim 21 wherein said latch member engages said latch aperture, in said slotted latch-guide by fitting said latch member into said aperture when said timer means allows said latch member to fall under the force of a return spring and said housing is slid on said bracket to overlay said door frame so that said latch member is aligned with said aperture.

* * * * *